US007437873B2

(12) United States Patent
Wanschura et al.

(10) Patent No.: US 7,437,873 B2
(45) Date of Patent: Oct. 21, 2008

(54) CONNECTION BLOCK FOR A HYDROSTATIC PISTON MACHINE

(75) Inventors: Guenter Wanschura, Ulm (DE); Jerzy Kreja, Nersingen (DE); Juergen Gintner, Elchingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 235 days.

(21) Appl. No.: 10/577,004

(22) PCT Filed: Oct. 11, 2004

(86) PCT No.: PCT/EP2004/011357

§ 371 (c)(1),
(2), (4) Date: Apr. 24, 2006

(87) PCT Pub. No.: WO2005/042973

PCT Pub. Date: May 12, 2005

(65) Prior Publication Data

US 2007/0130930 A1 Jun. 14, 2007

(30) Foreign Application Priority Data

Oct. 24, 2003 (DE) ..... 103 49 599

(51) Int. Cl.
*F04B 1/30* (2006.01)
*F04B 23/04* (2006.01)

(52) U.S. Cl. ..... 60/488; 60/444

(58) Field of Classification Search ..... 60/444, 60/484, 486, 488; 92/71
See application file for complete search history.

(56) References Cited

U.S. PATENT DOCUMENTS 2,445,281 A * 7/1948 Rystrom ..... 91/499

(Continued)

FOREIGN PATENT DOCUMENTS

DE 34 13 867 A1 4/1984

(Continued)

*Primary Examiner*—Thomas E Lazo
(74) *Attorney, Agent, or Firm*—Scully, Scott, Murphy & Presser, P.C.

(57) ABSTRACT

The invention relates to a connection block for a hydrostatic piston machine which is provided for simultaneous operation in a first hydraulic circuit and a second hydraulic circuit. A first working pressure duct (60) and a second working pressure duct (61) are formed in the connection block, via which ducts respectively a first and a second working line (7, 8) of the first hydraulic circuit can be connected to respectively a first and a second kidney-shaped control port of a control plate (52) of the hydrostatic piston machine. Furthermore, a third working pressure duct (62) and a fourth working pressure duct (63) are formed in the connection block (25), via which ducts respectively a third and a fourth working line (7', 8') of the second hydraulic circuit can be connected to respectively a third and a fourth kidney-shaped control port (70', 71') of the control plate of the hydrostatic piston machine. A common feeding pressure duct (80) is provided in the connection block (25), it being possible for the common feeding pressure duct (80) to be connected to the first to fourth working pressure duct (60, 61, 62, 63) respectively via a separate feeding device.

9 Claims, 8 Drawing Sheets

U.S. PATENT DOCUMENTS

Figure 1:
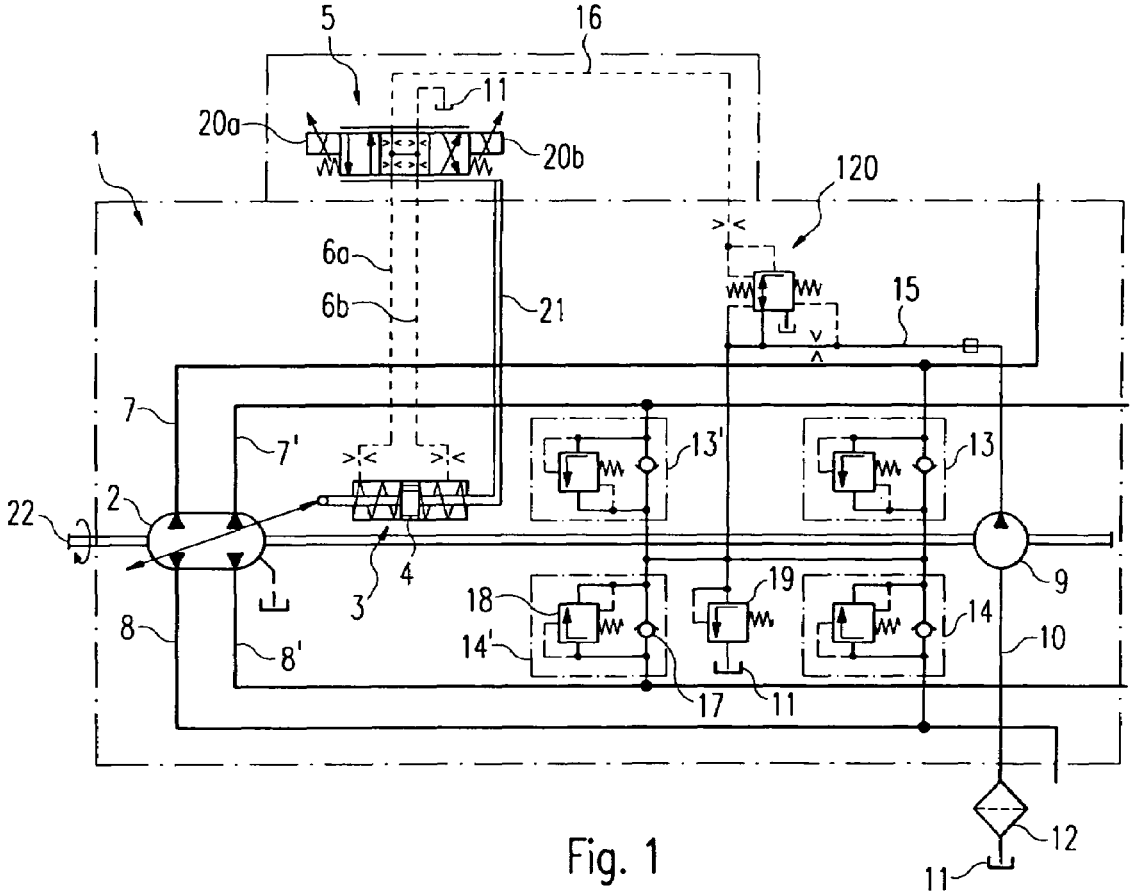

| | | | | | |
|---|---|---|---|---|---|
| 4,449,444 | A | * | 5/1984 | Forster | 91/506 |
| 4,617,853 | A | * | 10/1986 | Wagenseil et al. | 91/505 |
| 4,852,463 | A | * | 8/1989 | Wagenseil | 91/499 |
| 5,495,713 | A | * | 3/1996 | Leker | 60/488 |
| 6,276,133 | B1 | * | 8/2001 | Yoshida et al. | 60/486 |
| 6,425,244 | B1 | * | 7/2002 | Ohashi et al. | 60/486 |
| 2002/0157391 | A1 | | 10/2002 | Ohashi et al. | |

FOREIGN PATENT DOCUMENTS

| | | | |
|---|---|---|---|
| DE | 42 25 380 | A1 | 7/1992 |
| EP | 0 044 070 | A1 | 7/1981 |
| WO | WO 97/13065 | | 4/1997 |

* cited by examiner

CONNECTION BLOCK FOR A HYDROSTATIC PISTON MACHINE

The invention relates to a connection block for a hydrostatic piston machine which is provided for simultaneous operation in a first and a second hydraulic circuit.

An axial piston machine which is suitable for operation in a first and a second hydraulic circuit is known from DE 34 13 867 A1. To connect the working lines of the two hydraulic circuits, a connection block is provided, in which working pressure ducts are arranged. The working pressure ducts open onto the end face of the connection block towards a control plate, in which kidney-shaped control ports are formed. Cylinder spaces of a rotatably mounted cylinder drum are intermittently connected to the working lines on rotation of the cylinder drum via the kidney-shaped control ports.

The disadvantage with this machine is that only the connecting ducts are provided in the connection block, and the connection block thus serves exclusively for connecting the hydrostatic piston machine to the working lines. Feeding of pressure medium on starting the piston machine has to performed, however, by additional line connections. This increases the outlay when constructing the hydraulic installation. In particular, owing to the lines being routed outside the connection block, the construction space required increases and at the same time accessibility for maintenance measures deteriorates.

It is the object of the invention to provide a connection block for a hydrostatic piston machine which enables a compact hydraulic installation.

In the case of the connection block according to the invention, besides the working pressure ducts, a feeding pressure duct is additionally formed in the connection block. This feeding pressure duct can be connected to a working pressure duct respectively via a separate feeding device. Through the integration of the feeding pressure duct in the connection block, additional lines outside the connection block are avoided. The connection block is a compact unit which is built in a hydraulic installation together with the hydrostatic piston machine, without an additional supply of the feeding pressure to the working lines taking place outside the hydrostatic piston machine and the connection block.

The measures set out in the subclaims relate to advantageous developments of the connection block according to the invention.

In particular, it is advantageous also to integrate the feeding devices in the connection block as well. For this purpose, openings into which the feeding devices can be inserted are formed in the connection block. The feeding devices are therefore formed as a compact unit with the valves required for the feeding, which unit can be screwed as a compact subassembly, the so-called cartridge, jointly into the corresponding opening in the connection block.

Furthermore, it is advantageous to provide each feeding device with a high-pressure limiting valve. Each working pressure duct is thus assigned its own high-pressure limiting valve. If a pressure limit value in an individual working line is exceeded, relief can take place separately from the remaining working lines and the working pressure ducts connected thereto. Both the feeding and the high-pressure limiting are thus integrated in the connection block.

Furthermore, it is advantageous to arrange, at least for one hydraulic circuit, the two working pressure ducts in the connection block in such a way that the two connections lie on one side of the connection block. This enables the arrangement of all the feeding devices on another side of the connection block. The proximity of the common arrangement of the feeding devices leads, in turn, to a favourable, approximately symmetrical geometry of the feeding pressure duct. Further integration is achieved by arranging an auxiliary pump in the connection block.

The auxiliary pump is arranged in an opening of the connection block, the auxiliary pump preferably being designed as a crescent pump, the kidney-shaped high-pressure port of which is connected to the feeding pressure duct inside the connection block.

Figure 2:
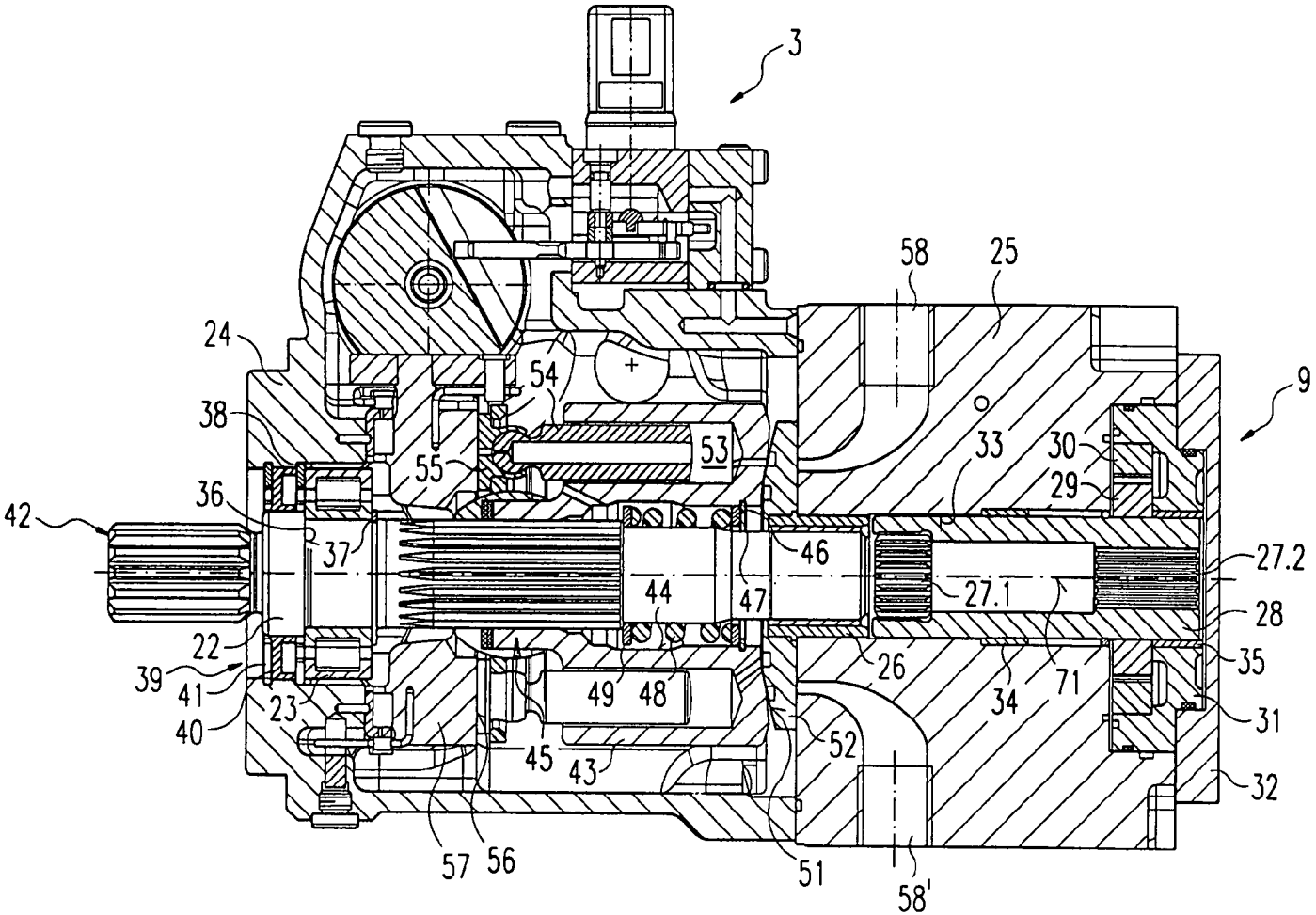
Figure 3:
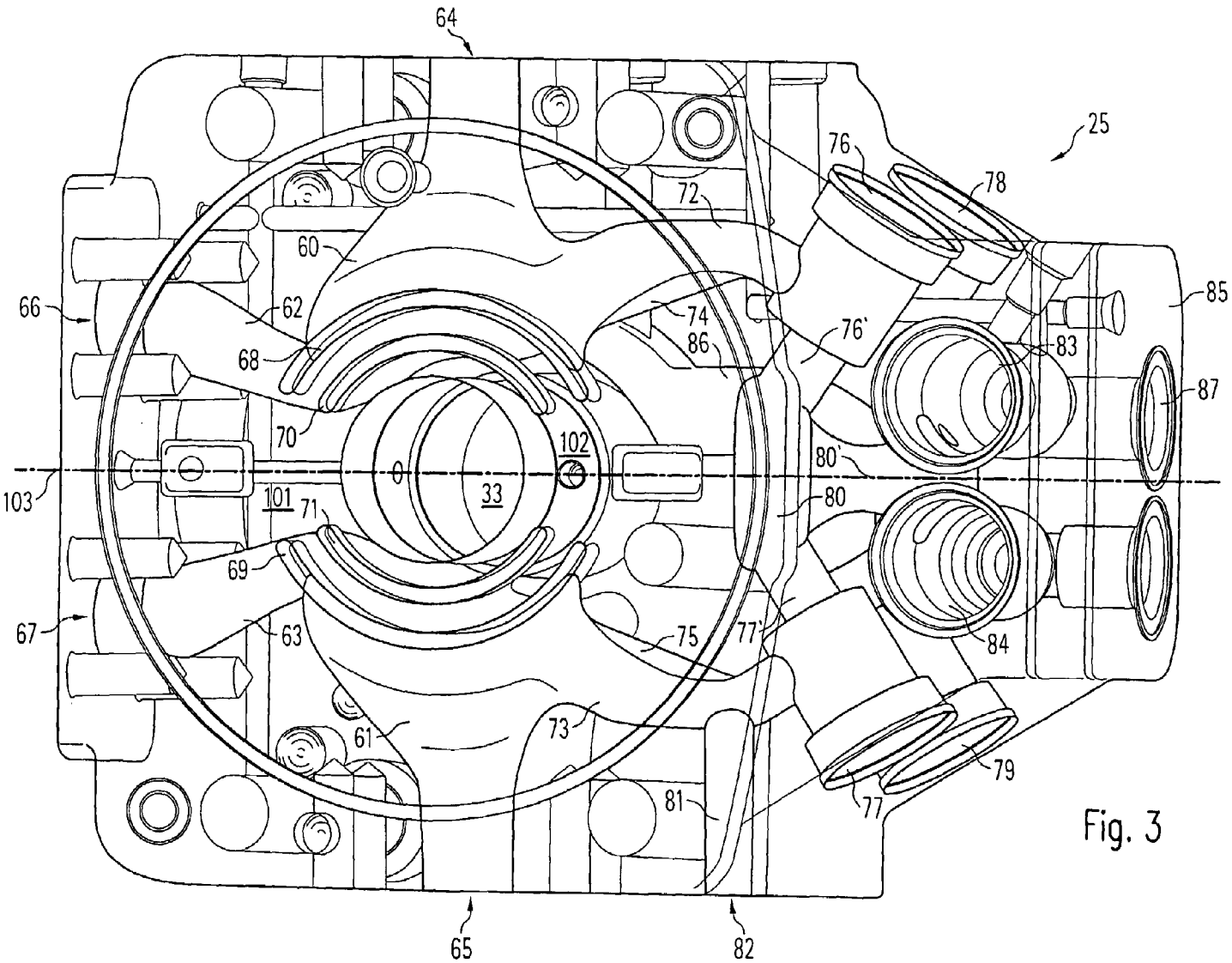
Figure 4:
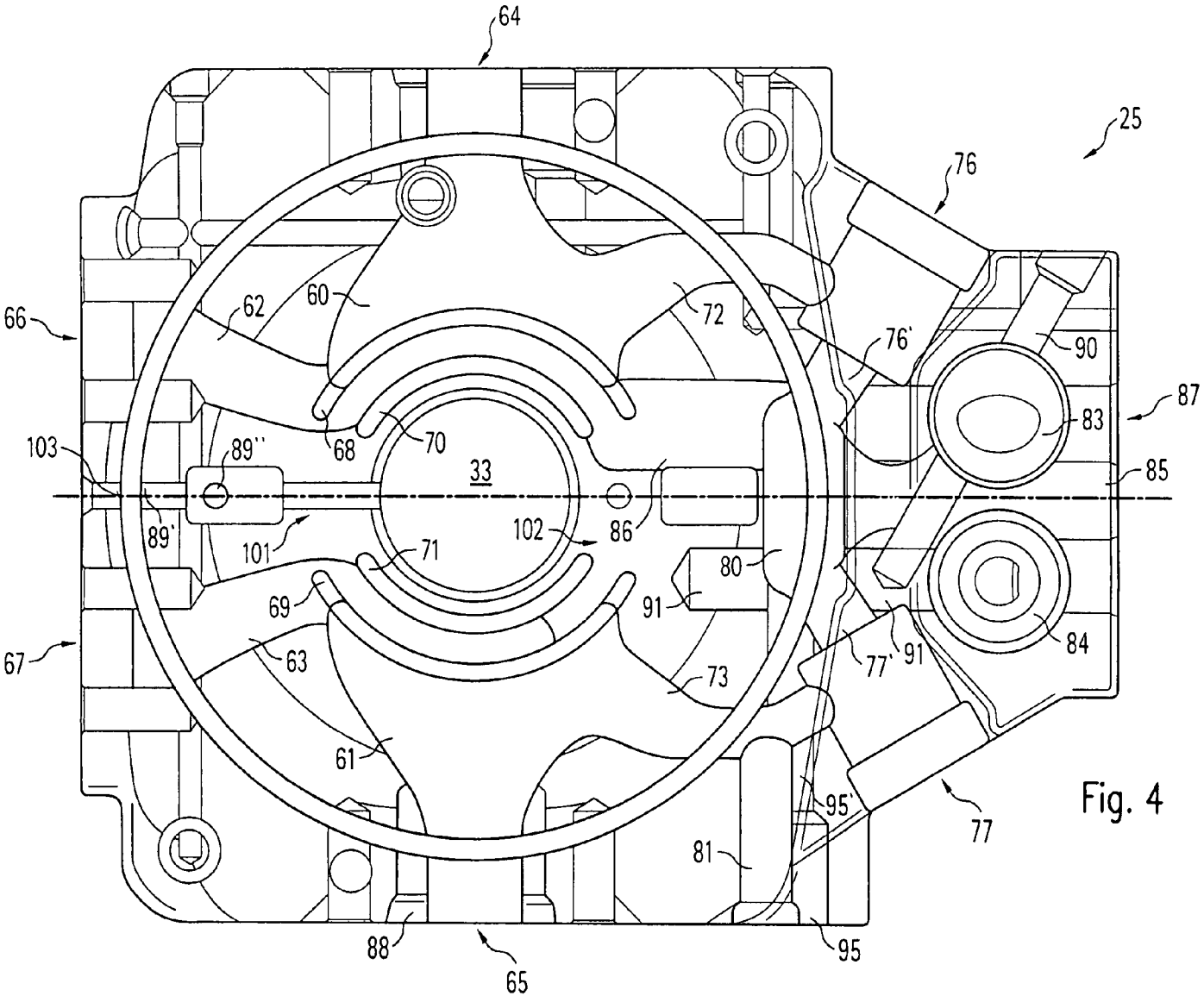
Figure 5:
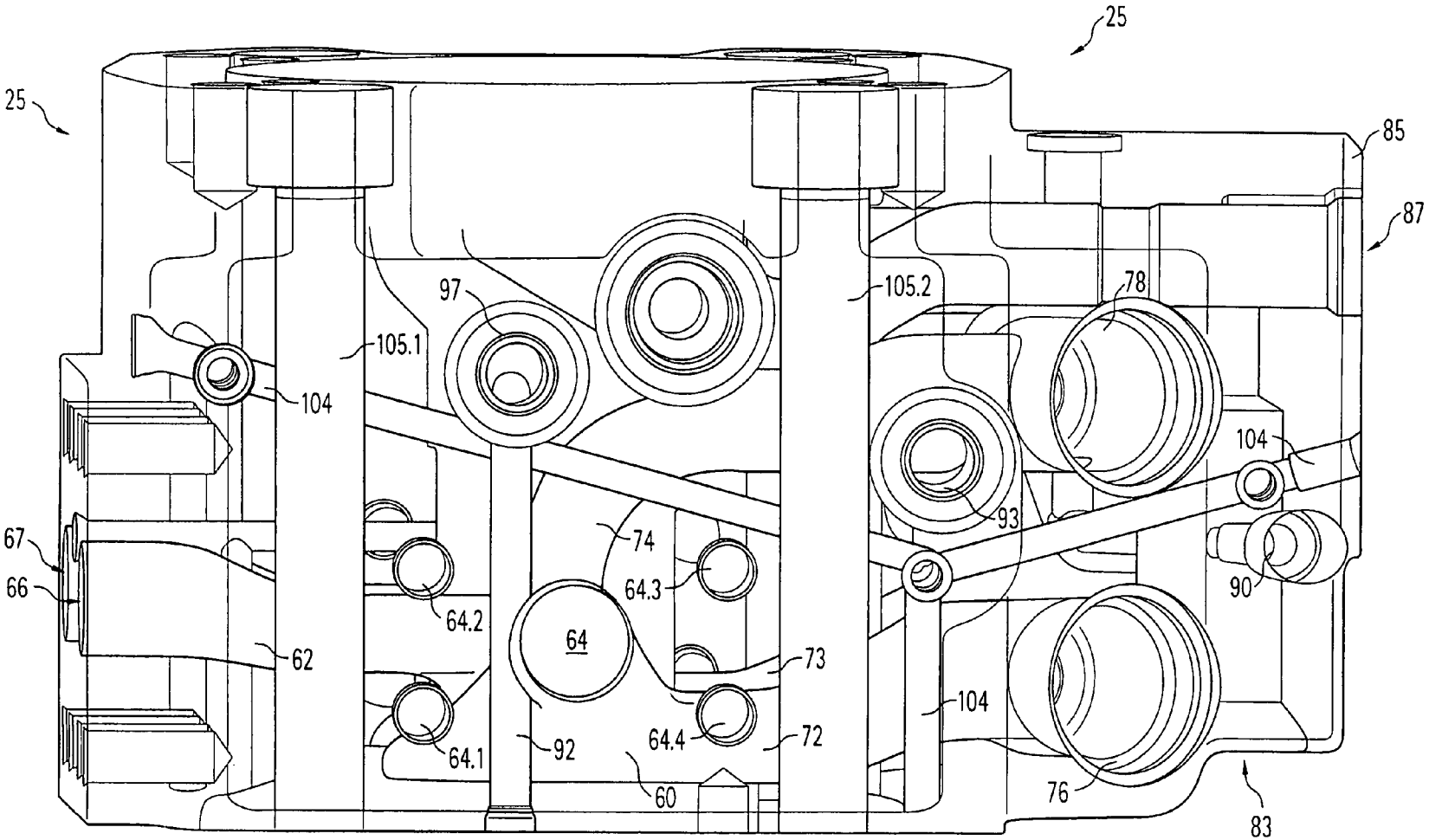
Figure 6:
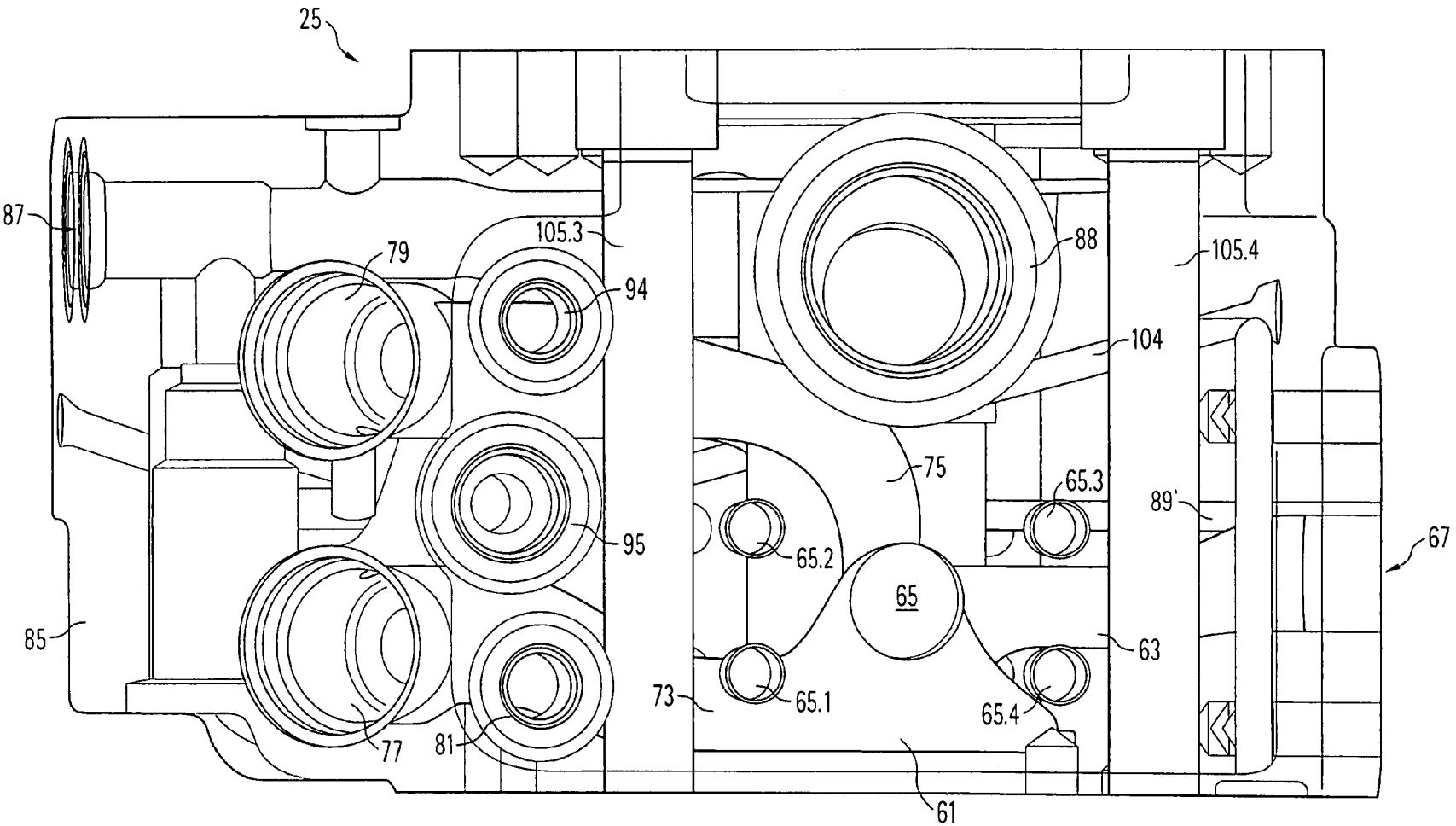
Figure 7:
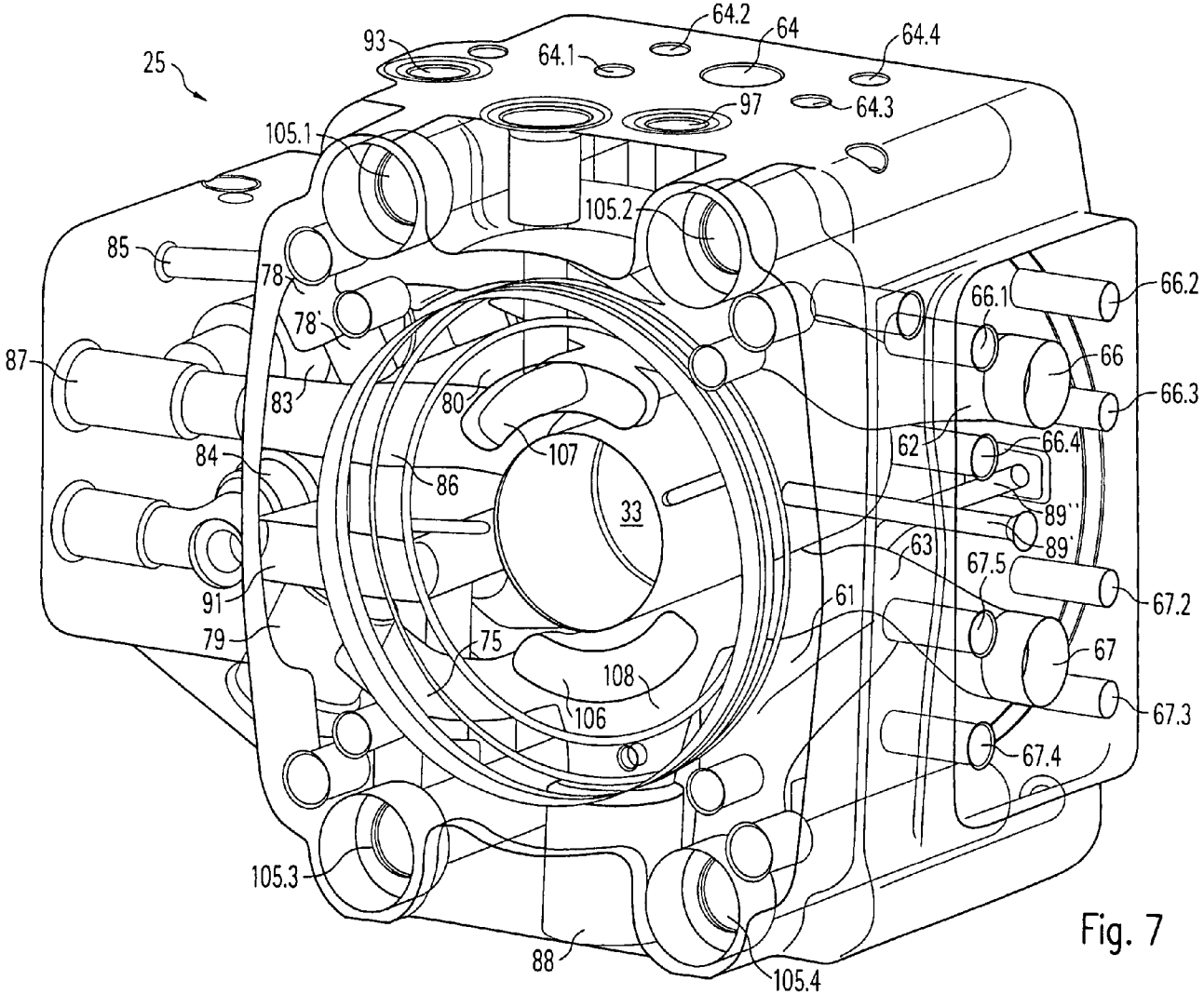
Figure 8:
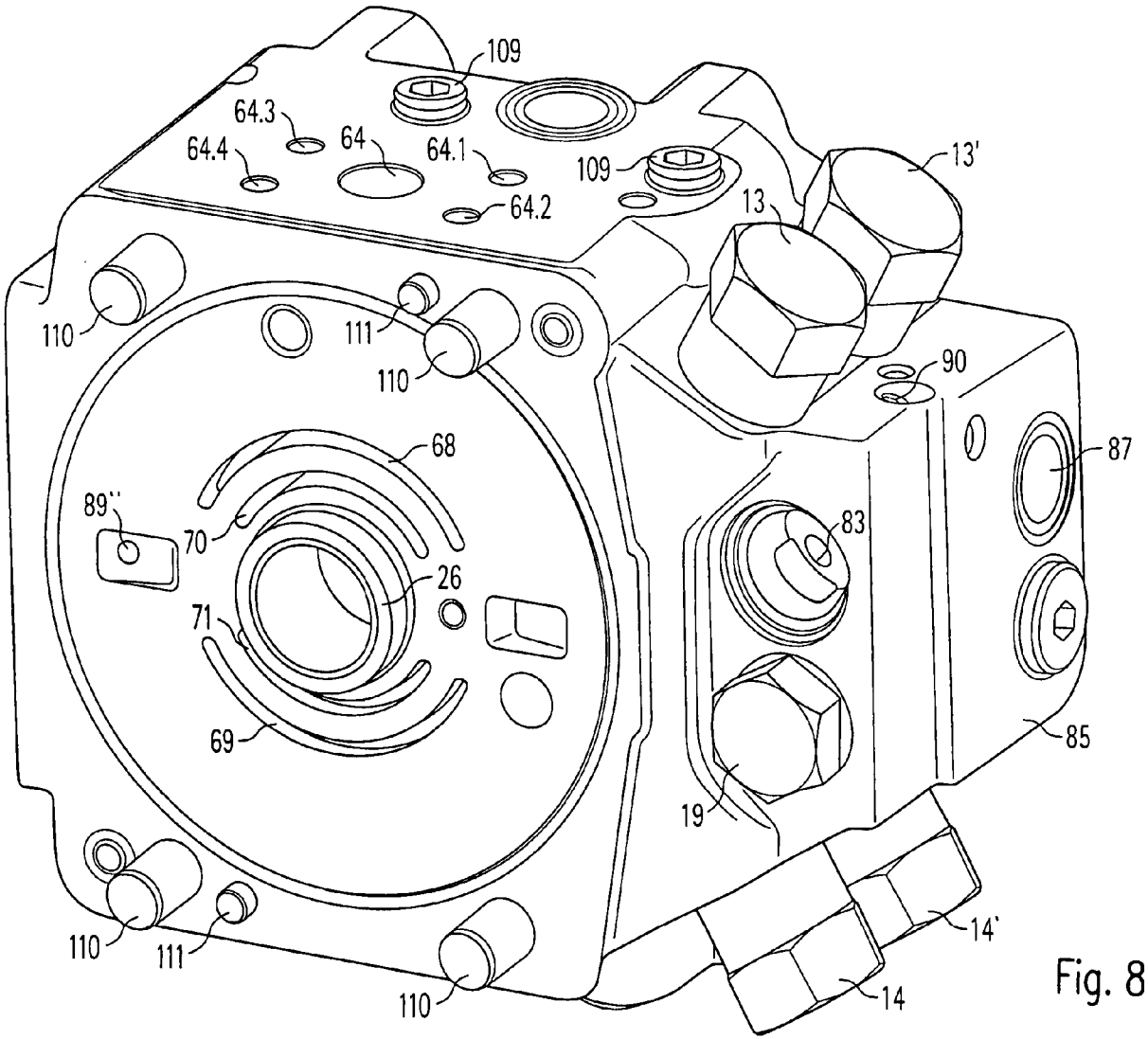

A preferred embodiment of the connection block according to the invention is illustrated in the drawing and explained in more detail in the following description. In the drawing:

FIG. 1 shows a hydraulic connection diagram of a hydrostatic piston machine operated in two hydraulic circuits, FIG. 2 shows a sectional illustration of a hydrostatic piston machine for operation in two hydraulic circuits, FIG. 3 shows a first perspective illustration of an exemplary embodiment of a connection block according to the invention, FIG. 4 shows a first plan view of the exemplary embodiment of the connection block according to the invention, FIG. 5 shows a second perspective illustration of the exemplary embodiment of a connection block according to the invention, FIG. 6 shows a third perspective illustration of the exemplary embodiment of a connection block according to the invention, FIG. 7 shows a fourth perspective illustration of the exemplary embodiment of a connection block according to the invention, and FIG. 8 shows an external view of a connection block as a preassembled unit.

Before discussing the design of an exemplary embodiment of a hydrostatic piston machine 1 according to the invention in detail, the basic structure of a piston machine 1 operated in two hydrostatic circuits will first be explained with the aid of the hydraulic connection diagram in FIG. 1. In the exemplary embodiment illustrated, the hydrostatic piston machine 1 comprises a pump 2 for parallel delivery of pressure medium to two separate, closed hydraulic circuits.

The delivery rate of the pump 2 can be changed by an adjusting device 3 for both hydraulic circuits together. The adjusting device 3 comprises a cylinder and a setting piston 4, which is arranged therein and is loaded, in a known manner, at piston surfaces oriented mutually opposite, with a setting pressure in respectively one setting pressure chamber. The two setting pressure chambers are connected via respectively one setting pressure line 6*a*, 6*b* to a setting pressure regulating valve 5.

By loading one setting pressure chamber and relieving the other setting pressure chamber, a pressure difference acts on the setting piston 4 and as a result of this the setting piston 4 is deflected from its central position, in which it is held by two centring springs. Through the deflection of the setting piston 4, the pump 2 is set to a changed delivery volume. The adjustment acts both on the first and the second hydraulic circuit.

The first hydraulic circuit is formed from a first working line 7 and a second working line 8. The pump 2 delivers either to the first working line 7 or to the second working line 8. Owing to the common adjustment, in the case of a delivery to the first working line 7, pressure medium is simultaneously delivered to a third working line 7' of the second hydraulic circuit or, in the case of delivery to the second working line 8 of the first hydraulic circuit, pressure medium is simultaneously delivered to a fourth working line 8' of the second hydraulic circuit.

The first hydraulic circuit, comprising its first working line 7 and its second working line 8, is hydraulically independent of the second hydraulic circuit, comprising its third working line 7' and its fourth working line 8'.

On starting the pump 2, the first hydraulic circuit and the second hydraulic circuit are initially fed with pressure medium by an auxiliary pump 9. For this purpose, the auxiliary pump 9 sucks in pressure medium from a tank volume 11 via a suction line 10. To filter the pressure medium, a filter 12 is arranged in the suction line 10 outside the housing of the hydrostatic piston machine 1 and frees the sucked-in pressure medium of impurities.

For feeding to the first hydraulic circuit, a first feeding device 13 and a second feeding device 14 are provided, the first feeding device 13 being connected to the first working line 7 of the first hydraulic circuit and the second feeding device 14 being connected to the second working line 8 of the first hydraulic circuit. Analogously to this, a third feeding device 13' is connected to the third working line 7' of the second hydraulic circuit and a fourth feeding device 14' is connected to the fourth working line 8' of the second hydraulic circuit.

The first to fourth feeding device 13, 13', 14 and 14' are commonly connected to a feeding pressure duct 15, to which the auxiliary pump 9 delivers the sucked-in pressure medium. In a known manner, as illustrated in FIG. 1 with a reference symbol merely in the case of the fourth feeding device 14', respectively one nonreturn valve 17 is arranged in the feeding devices 13 to 14', which valve opens a flow path from the feeding pressure duct 15 in the direction of the respectively connected working line 7, 8, 7' or 8' in order to feed pressure medium, as long as the pressure in the feeding pressure duct 15 is greater than the respective working pressure. Arranged in parallel with the nonreturn valve 17 in the feeding devices 13, 13', 14 and 14' is respectively one high-pressure limiting valve 18. If a critical pressure in the respective working line 7, 8, 7' or 8' is exceeded, the respective high-pressure limiting valve 18 opens in the direction of the feeding pressure duct 15.

If the pressure in the feeding pressure duct 15 rises on the opening of such a high-pressure limiting valve 18 for example, then above a limit value for the feeding pressure a pressure limiting valve 19 is opened, through which the feeding pressure duct 15 is relieved to the tank volume 11. Consequently, a defined pressure level is maintained in the feeding pressure duct 15, since even in the case of an increased delivery output, by raising the auxiliary pump speed for example, the pressure limiting valve 18 opens.

The setting pressure regulating valve 5 is designed as a 4/3-way valve, which is continuously adjustable. To set a particular position, the setting pressure regulating valve 5 is loaded, starting from its neutral position, in which it is held by compression springs, with a force acting in the axial direction. This force is generated as a force difference between two proportional magnets 20*a* and 20*b*, which act with respectively one compression spring in the same direction on a valve piston of the setting pressure regulating valve 5. The respectively set position of the setting piston 4 is taken into consideration when regulating the setting pressure, in that a valve sleeve of the setting pressure regulating valve 5 is connected to the setting piston 4 via a coupling rod 21.

In order to be able to load the setting pressure chambers with a setting pressure, the setting pressure regulating valve 5 is connected to the feeding pressure duct 15 via a setting pressure supply line 16. On starting the pump 2, the adjusting device 3 can thus be actuated from the time when the auxiliary pump 9 has built up a pressure in the feeding pressure duct 15. The adjusting device 3 can thus be actuated independently of the amount of pressure medium delivered by the pump 2 to the first hydraulic circuit or second hydraulic circuit.

In the exemplary embodiment illustrated, the auxiliary pump 9 and the pump 2 are driven by a common drive shaft 22.

The longitudinal section, illustrated in FIG. 2, of the hydrostatic piston machine according to the invention shows how the common drive shaft 22 is supported at one end of a pump housing 24 by a roller bearing 23. In addition, the common drive shaft 22 is supported in a sliding bearing 26, which is arranged in a connection block 25, which closes the pump housing 24 at the opposite end.

Formed in the connection block 25 is an opening 33 which passes right through the connection block in the axial direction and in which on the one hand the sliding bearing 26 is arranged and through which on the other hand the common drive shaft 22 passes. On the side of the connection block 25 facing away from the pump housing 24, the auxiliary pump 9 is inserted into a radial widening of the opening 33. To drive the auxiliary pump 9, the common drive shaft 22 has toothing 27.1, which engages with the corresponding toothing of the auxiliary pump shaft 28. The auxiliary pump shaft 28 is supported in the opening 33 by a first auxiliary pump sliding bearing 34 and in the auxiliary pump connection plate 31 by a second auxiliary pump sliding bearing 35.

Arranged on the auxiliary pump shaft 28 is a gear wheel 29, which engages with an internal-geared wheel 30. Via the gear wheel 29, the internal-geared wheel 30, which is arranged rotatably in the auxiliary pump connection plate 31, is likewise driven by the auxiliary pump shaft 28 and thus ultimately by the common drive shaft 22. The suction- and the pressure-side connection for the auxiliary pump 9 are formed in the auxiliary pump connection plate 31. The auxiliary pump 9 is fixed in the radial widening of the opening 33 of the connection block 25 by a cover 32, which is mounted on the connection block 25.

In a particularly preferred embodiment of the connection block 25 according to the invention, the suction- and the pressure-side connection are formed in the connection block 25, as will be explained below in the detailed description of the connection block 25 according to the invention with the aid of FIGS. 3 to 8.

The inner race of the roller bearing 23 is fixed in the axial direction on the common drive shaft 22. The inner race bears on one side against a collar 36 of the common drive shaft 22 and is held in this axial position on the other side by a circlip 37 which is inserted in a groove of the common drive shaft 22. The axial position of the roller bearing 23 with respect to the pump housing 24 is determined by a circlip 38 which is inserted into a circumferential groove of the shaft opening 39. In the direction of the outside of the pump housing 24, additionally a sealing ring 40 and finally a further circlip 41 are arranged in the shaft opening 39, the circlip 41 being inserted into a circumferential groove of the shaft opening 39.

Formed at the end of the common drive shaft 22 projecting from the pump housing 24 is drive toothing 42, via which the hydrostatic piston machine is driven by a prime mover (not illustrated).

Arranged in the interior of the pump housing 24 is a cylinder drum 43, having a central through-opening 44, through which the common drive shaft 22 passes. Via further drive toothing 45, the cylinder drum 43 is connected to the common drive shaft 22 in a manner locked against relative rotation but displaceable in the axial direction, so that a rotational movement of the common drive shaft 22 is transmitted to the cylinder drum 43.

Inserted into a groove formed in the central through-opening 44 is a further circlip 46, against which a first supporting disc 47 bears. The first supporting disc 47 forms a first spring bearing for a compression spring 48. A second spring bearing for the compression spring 48 is formed by a second supporting disc 49, which is supported on the end face of the further drive toothing 45. The compression spring 48 thus exerts a force in the opposite axial direction respectively on the common drive shaft 42 on the one hand and on the cylinder drum 43 on the other hand. The common drive shaft 22 is stressed such that the outer race of the roller bearing 23 is supported on the disc 38.

In the opposite direction, the compression spring 48 acts on the cylinder drum 43, which is held in contact with a control plate 52 by a spherical indentation 51 formed at the end face of the cylinder drum 43. The control plate 52, in turn, bears sealingly against the connection block 25 by the side facing away from the cylinder drum 43. As a result of the spherical indentation 51, which corresponds with a corresponding spherical protuberance of the control plate 52, the cylinder drum 43 is centred. The control plate 52 may also be of plane design.

The position of the control plate 52 in the radial direction is fixed by the outer circumference of the sliding bearing 26. For this purpose, the sliding bearing 26 is only partly inserted into the opening 33 in the connection block 25.

Made in the cylinder drum 43 in a manner distributed over a common divided circle are cylinder bores 53, in which pistons 54, which are longitudinally displaceable in the cylinder bores 53, are arranged. The pistons 54 project partly from the cylinder drum 43 at the end facing away from the spherical indentation 51. At this end, respectively one slide shoe 55 is fastened to the pistons 54, via which the pistons 54 are supported on a running surface 56 of a pivoting plate 57.

To produce a stroke movement of the pistons 54, the angle which the running surface 56 of the pivoting plate 57 encloses with the centre axis, can be changed. For this purpose, the pivoting plate 57 can be adjusted in its inclination by the adjusting device 3. To absorb the forces transmitted by the slide shoes 55 to the pivoting plate 57, the pivoting plate 57 is supported by a roller bearing in the pump housing 24.

To connect the hydrostatic piston machine 1 to a first hydraulic circuit and to a second hydraulic circuit, a first connection 58 for a first working line and a second connection 58' for a second working line are illustrated schematically in the connection block 25, and these lines can be connected, in a manner not shown, to the cylinder bores 53 via the control plate 52.

FIG. 3 shows a perspective illustration of a connection block 25 according to the invention. The connection block 25 is illustrated substantially from the side of the control plate 52. A first working pressure duct 60 and a second working pressure duct 61 are arranged in the connection block 25. The first working pressure duct 60 and the second working pressure duct 61 are assigned to the first hydraulic circuit. A third working pressure duct 62 and a fourth working pressure duct 63 are assigned to the second hydraulic circuit. The four working pressure ducts 60 to 63 respectively connect the suction- and pressure-side working lines 7, 7', 8 and 8' of the first and second hydraulic circuit to the corresponding kidney-shaped control ports of the control plate 52, depending on the working direction of the pump 2.

At the end of the working pressure duct 60 formed on the outside of the connection block 25 is formed a first connection 64, to which the first working line 7 of the first hydraulic circuit can be connected. To connect the second working line 8 of the first hydraulic circuit, a second connection 65 is formed at the end of the second working pressure duct 61 situated on the outside, on the side diametrically opposite with respect to the longitudinal axis of the connection block 25.

Correspondingly, a third connection 66 and a fourth connection 67 are also formed on the outside of the connection block 25 for the third working pressure duct 62 and the fourth working pressure duct 63. The third connection 66 and the fourth connection 67 are arranged, however, on the same side of the connection block 25. The ends of the working pressure ducts 60 to 63 facing respectively away from the connections 64 to 67 open onto a surface of the connection block 25 against which the control plate 52 bears sealingly. The mouths are kidney-shaped. The position of the mouths of the first working pressure duct 60 and of the second working pressure duct 61 corresponds with the position of a first kidney-shaped control port and of a second kidney-shaped control port in the control plate 52 and are provided with the reference symbols 68 and 69 in the drawing.

While the working pressure ducts 60 to 63 are produced during the actual process of casting a rough part of the connection block 25 by employing appropriate mould parts, the connections 64 and 65 are produced subsequently by preferably machining processes, in order to ensure sufficient surface quality for a sealing connection to the first and the second working line 7 and 8. The kidney-shaped mouths 68 and 69 are likewise made in the cast rough part, e.g. by milling. The connections and openings lying on the outside of the connection block 25 and still to be described below are likewise produced by machining, the ducts connected thereto each being produced during the actual casting of the rough part by mould parts.

Furthermore, a third kidney-shaped control port 70' and a fourth kidney-shaped control port 71' are formed in the control plate 52 (not illustrated in FIG. 3), and these ports extend along respectively one segment of a further circular arc with a smaller diameter. Corresponding mouths 70 and 71 of the third working pressure duct 62 and of the fourth working pressure duct 63 correspond with the position of the third kidney-shaped control port 70' and of the fourth kidney-shaped control port 71' in the control plate 52. The mouths 68 to 71 of the working pressure ducts 60 to 63 are thus connected to the kidney-shaped control ports 68' to 71' in a manner permitting a throughflow.

The first working pressure duct 60 is connected to a first opening 76 via a first connecting duct 72. Correspondingly, the second, third and fourth working pressure duct 61, 62 and 63 are also connected to a second, third and fourth opening 77, 78 and 79 via respectively a second, third and fourth connecting duct 73, 74 and 75.

Furthermore, a common feeding pressure duct 80 is connected to the first to fourth opening 76 to 79. The first to fourth openings 76 to 79 are provided for receiving the feeding devices 13, 14, 13' and 14' (not illustrated in FIG. 3). As has already been stated in the explanation of the hydraulic connection diagram in FIG. 1, the feeding devices 13, 14, 13' and 14' contain respectively one nonreturn valve 17, which opens in the direction of the respective working pressure duct 60 to 63. When the nonreturn valve 17 is open, pressure medium flows from the common feeding pressure duct 80 to the corresponding working pressure duct 60 to 63 as long as the pressure in the feeding pressure duct 80 is higher than in the respective working line 7, 8, 7' and 8'.

The pressures in the four working lines 7, 8, 7' and 8' can be measured separately via a first to fourth measuring connection. To measure the pressure prevailing in the second working line 8 of the first hydraulic circuit, a second measuring duct 81 branches off from the second connecting duct 73 and opens onto the outside of the housing at a second measuring connection 82. The first measuring connection, provided for measuring the working line pressure of the first working line 7, will be explained with reference to the description of the figures below.

The first opening 76 and the second opening 77, provided for receiving the feeding devices 13 and 14 of the first hydraulic circuit, are in a V-shaped arrangement and are made in the connection block 25 on the side facing away from the third connection 66 and the fourth connection 67. The third opening 78 and the fourth opening 79 are likewise in a V-shaped arrangement with a preferably identical opening angle. The third opening 78 and fourth opening 79, assigned to the second hydraulic circuit, are arranged offset from the first opening 76 and the second opening 77 in the axial direction with respect to the longitudinal axis. Correspondingly, the feeding pressure duct 80 also extends in the axial direction. The connection of the feeding pressure duct 80 to the openings 76 to 79 is effected via respectively one feeding pressure connecting duct 76' to 79'. In FIG. 3, only the feeding pressure connecting ducts 76' and 77' leading to the first opening 76 and the second opening 77 can be seen in the foreground, while the two remaining feeding pressure connecting ducts 78' and 79' of the third and fourth opening 78 and 79 are hidden.

Furthermore, a regulating valve opening 83 and a low-pressure valve opening 84 are arranged in an extension 85 of the connection block 25. A regulating valve 120 (illustrated in FIG. 1) can be inserted, preferably screwed, into the regulating valve opening 83. The regulating valve opening 83 and the low-pressure valve opening 84 are made in the extension 85 in a manner oriented parallel to the longitudinal axis and are each likewise connected to the feeding pressure duct 80 via a connecting duct 80'. The regulating valve opening 83 is provided for receiving a cartridge, which generates a speed-dependent control pressure depending on the driving speed of the pump. In contrast, the pressure limiting valve 19 is inserted into the low-pressure valve opening 84.

In the background of FIG. 3 there can be seen an auxiliary pressure duct 86, which connects an auxiliary pressure outlet of the auxiliary pump 9 to the feeding pressure duct 80. The auxiliary pressure duct 86 is led out of the connection block 25 laterally through the extension 85, its orifice 87 being closed by a plug during operation, where it is intended to operate an auxiliary pump 9 in the connection block 25. If an external auxiliary pressure source is used, its auxiliary pressure supply line is connected to the auxiliary pressure duct 86.

The arrangement of the first to fourth opening 76 to 79, as well as of the setting pressure regulating valve opening 83 and of the low-pressure valve opening 84, is approximately symmetrical with respect to a plane of symmetry 103 running through a first separating web 101 and a second separating web 102.

FIG. 4 illustrates a plan view of the side of the connection block 25 facing the control plate 52. Only the first opening 76 and the second opening 77, as well as the first connecting duct 72 and the second connecting duct 73, can be seen. The equivalent openings and connecting ducts for the second hydraulic circuit cannot be seen in the illustration of FIG. 4, since they are hidden, being arranged offset therefrom in the axial direction. It can also be seen that the regulating valve opening 83 intersects the auxiliary pressure duct 86, so that the feeding pressure generated by the auxiliary pump 9 is supplied, via the auxiliary pressure duct 86, to the regulating valve inserted into the regulating valve opening 83.

A suction connection 88, which is connected to a kidney-shaped suction port of the auxiliary pump 9, can be seen, partly hidden by the second connection 65. In order to provide the sliding bearing 26 arranged in the opening 33 with pressure medium for lubrication, a transverse bore 89' and a longitudinal bore 89" are arranged in the connection block 25 in such a way that a continuous connection leads from the end face of the connection block 25 to the opening 33.

To discharge leakage pressure medium, a leakage oil bore 90 passes through the regulating valve opening 83 and opens into a drainage duct 91, which is made from the outside by boring into the extension 85 and is connected to the low-pressure valve opening 84. Via the drainage duct 91, both the leakage oil of the regulating valve and the pressure medium which drains off owing to the relief when the pressure limiting valve 19 is open are discharged into the housing volume.

Furthermore, in FIG. 4 it can be seen that the first working pressure duct 60 and the second working pressure duct 61 widen in the direction of the mouths 68 and 69, and the first and the second connecting duct 72 and 73 open into this widened region from the side of the extension 85.

FIG. 5 illustrates a side view of the side of the first connection 64. The axially offset arrangement of the first opening 76 and of the second opening 78, as well as the course of the first connecting duct 72 and of the third connecting duct 74, can be seen clearly. To measure the pressure prevailing in the first working pressure duct 60 and in the first working line 7, connected thereto, of the first hydraulic circuit, a first measuring connection 97 is provided, which is connected to the first working pressure duct 60 via a first connecting bore 92.

To measure the pressure prevailing in the third working line 7', a third measuring connection 93 is provided. The third measuring connection 93 is formed at the end of a measuring bore arranged on the outside of the connection block 25, which bore opens into the third connecting duct 74 and is thus connected to the latter.

Furthermore, in FIG. 5 there is formed a system of intersecting bores 104, which together form a controlling duct system. In order to produce a closed-off controlling duct system, the bores are closed by plugs on the outside of the connection block 25.

Made around the first connection 64 in the connection block 25 are four blind holes 64.1 to 64.4, which, provided with a thread, serve for fastening the first working line 7.

To fasten the entire connection block 25 to a piston machine, fastening bores 105 pass through the connection block in the axial direction, two fastening bores being illustrated in FIG. 5 and provided with the reference symbols 105.1 and 105.2.

FIG. 6 shows a side view of the side opposite the side shown in the illustration of FIG. 5. This figure shows the second measuring connection 81, which is connected directly to the second connecting duct 73 via a measuring bore. Furthermore, a fourth measuring connection 94, which is likewise connected directly to the fourth connecting duct 75 via a measuring bore, is shown. Formed between the second measuring connection 81 and the fourth measuring connection 94 is an auxiliary pressure connection 95, which is connected to the feeding pressure duct 80 via a bore 95'. Via the auxiliary pressure connection 95, further hydraulic consumers for example can be supplied with the feeding pressure of the auxiliary pump 9.

In this view, the two remaining fastening bores 105.3 and 105.4 are also shown. All the fastening bores 105 have, on the side facing the auxiliary pump 9, an enlargement of the diameter, enabling countersinking of the fastening screws which are screwed into a thread provided in the housing (not illustrated) of the piston machine.

To fasten the second working line 8 to the connection block 25, in turn, four blind holes 65.1 to 65.4 are made around the second connection 65 in the connection block 25.

FIG. 7 shows the connection block 25 from the side on which the auxiliary pump 9 is arranged. In the recessed region which receives the auxiliary pump 9, a kidney-shaped suction port 106 and a kidney-shaped auxiliary pressure port 107 are made. The kidney-shaped auxiliary pressure port 107 is connected to the feeding pressure duct 80 via the auxiliary pressure duct 86, as has already been explained with reference to FIG. 3. The kidney-shaped suction port 106 is connected to the connection 88 via a suction duct 108, to which, in turn, the suction line 10 is connected.

The remainder of the ducts and bores illustrated in FIG. 7 have already been explained in the description of FIGS. 3 to 6. Repeated description is therefore dispensed with, in order to avoid unnecessary repetition.

A perspective view of the connection block is shown in FIG. 8. Here, the feeding devices 13, 13', 14 and 14', which are designed as cartridges, are inserted into the corresponding openings 76 to 79. Furthermore, the pressure limiting valve 19 is inserted into the low-pressure valve opening 84. Consequently, the connection block 25 is a preassembled unit, in which there are already present all the components which, on the one hand, are necessary for feeding the two hydraulic circuits on starting the piston machine and which, on the other hand, prevent a rise of the pressure in the working lines above a critical value for each working line 7, 8, 7' and 8' individually.

The measuring connections are closed by plugs 109. Projecting from the fastening bores 105 in the direction of the hydrostatic piston machine are screws 110 and alignment pins 111, which pins are introduced into corresponding openings in the end face, for exact definition of the position of the connection block 25 with respect to the hydrostatic machine.

The arrangement described enables not only a high degree of integration in terms of the functionality of the connection block 25, but also allows the overall length of the connection block 25 to be kept small owing to the routing of the individual ducts, as well as the arrangement of the corresponding connections on the outside of the connection block 25. Moreover, all the valves on which possible maintenance work may be required are arranged on only one side of the connection block 25. This results in simplified maintenance, since the valves are all accessible from the same side in the assembled state. Furthermore, no lines have to be disassembled, since all the necessary connections are formed as ducts in the interior of the connection block 25 and the valves used are merely inserted as cartridges into openings provided therefor.

The invention claimed is:

1. Connection block for a hydrostatic piston machine which is provided for simultaneous operation in a first hydraulic circuit and a second hydraulic circuit, a first working pressure duct and a second working pressure duct being formed in the connection block, via which ducts respectively a first and a second working line of the first hydraulic circuit is connectable to respectively a first and a second kidney-shaped control port of a control plate of the hydrostatic piston machine, and a third working pressure duct and a fourth working pressure duct being formed in the connection block, via which ducts respectively a third and a fourth working line of the second hydraulic circuit is connectable to respectively a third and a fourth kidney-shaped control port of the control plate of the hydrostatic piston machine, wherein a common feeding pressure duct is provided in the connection block, it being possible for the common feeding pressure duct to be connected to the first to fourth working pressure duct respectively via a separate feeding device; and wherein said common feeding pressure duct is provided with a setting pressure supply line for connection to a setting pressure regulating valve that actuates an adjusting device.

2. Connection block according to claim 1, wherein the feeding devices is insertable into openings of the connection block.

3. Connection block according to claim 1, wherein in each of the four feeding devices a high-pressure limiting valve is provided, by which, upon a pressure limit value being exceeded, the pressure in the corresponding working line, which is connected to the first to fourth working pressure duct is relieved to the common feeding pressure duct of the connection block.

4. Connection block according to claim 1, wherein at least the first and the second working pressure duct or the third and the fourth working pressure duct open onto one side of the connection block.

5. Connection block according to claim 1, wherein the working pressure ducts open in a kidney shape, at their ends facing away from the working lines, onto an end surface of the connection block oriented towards the control plate.

6. Connection block according to claim 5, wherein the kidney-shaped mouths of the first and the second working pressure duct extend along a first divided circle on the end face of the connection block.

7. Connection block according to claim 5, wherein the kidney-shaped mouths of the third and the fourth working pressure duct extend along a second divided circle on the end face of the connection block.

8. Connection block according to claim 1, wherein an auxiliary pump, which delivers to the feeding pressure duct, is insertable into the connection block on the side of the latter facing away from the hydrostatic piston machine.

9. Connection block according to claim 1, wherein all the feeding devices are arranged on a common side of the connection block.

* * * * *